US009611679B2

(12) United States Patent
Wollacott et al.

(10) Patent No.: US 9,611,679 B2
(45) Date of Patent: Apr. 4, 2017

(54) RETENTION ARRANGEMENT

(71) Applicant: Weston Body Hardware Limited, Worcestershire (GB)

(72) Inventors: Martin Wollacott, Worcestershire (GB); Gary Crosby, Worcestershire (GB)

(73) Assignee: Weston Body Hardware Limited, Worcestershire (GB)

( * ) Notice: Subject to any disclaimer, the term of this patent is extended or adjusted under 35 U.S.C. 154(b) by 231 days.

(21) Appl. No.: 14/252,894

(22) Filed: Apr. 15, 2014

(65) Prior Publication Data

US 2014/0306467 A1 Oct. 16, 2014

(30) Foreign Application Priority Data

Apr. 16, 2013 (GB) ..... 1306883.8

(51) Int. Cl.
*E05B 15/02* (2006.01)
*E05C 17/46* (2006.01)
(Continued)

(52) U.S. Cl.
CPC ..... *E05C 17/46* (2013.01); *E05B 15/0006* (2013.01); *E05B 15/006* (2013.01);
(Continued)

(58) Field of Classification Search
CPC ..... E05C 19/04; E05C 19/009; E05B 15/006; E05B 15/021; E05B 15/022; E05B 17/2011; E05B 63/121; E05B 63/244
(Continued)

(56) References Cited

U.S. PATENT DOCUMENTS 3,658,370 A * 4/1972 Wang ..... E05B 47/0002 24/303
3,764,172 A * 10/1973 Standke ..... E05B 47/0002 292/15
(Continued)

FOREIGN PATENT DOCUMENTS

BE 821351 A1 2/1975
DE 2448300 A1 * 4/1975 ..... E05B 63/121
(Continued)

OTHER PUBLICATIONS

Search Report for corresponding UK Patent Application GB1306883.8 mailed Nov. 29, 2013.

*Primary Examiner* — Carlos Lugo
(74) *Attorney, Agent, or Firm* — NK Patent Law, PLLC

(57) ABSTRACT

A retention arrangement for releasably securing a closure against a fixed body is provided. The retention arrangement includes a housing defining a mouth configured to receive a striker and defining a longitudinal axis, and at least one retention element configured to selectively retain the striker within the mouth, and movable between an open position and a closed position. The retention element is resiliently biased towards the closed position. The retention element is configured to open upon displacement due to the striker along the longitudinal axis in a first direction, and to close upon complete insertion of the striker within the mouth. The retention element is configured for rotation about at least two non-parallel axes so as to direct the striker towards the mouth.

29 Claims, 6 Drawing Sheets

(51) Int. Cl.

| | |
|---|---|
| *E05C 19/00* | (2006.01) |
| *E05B 63/24* | (2006.01) |
| *E05B 17/20* | (2006.01) |
| *E05B 15/00* | (2006.01) |
| *E05C 19/04* | (2006.01) |
| *E05B 63/12* | (2006.01) |
| *E05B 83/42* | (2014.01) |

(52) U.S. Cl.
CPC ..... *E05B 15/021* (2013.01); *E05B 15/022* (2013.01); *E05B 17/2011* (2013.01); *E05B 63/121* (2013.01); *E05B 63/244* (2013.01); *E05B 83/42* (2013.01); *E05B 2015/0235* (2013.01); *E05C 19/009* (2013.01); *E05C 19/04* (2013.01); *Y10T 292/696* (2015.04)

(58) Field of Classification Search
USPC ..... 292/252, 341.15
See application file for complete search history.

(56) References Cited

U.S. PATENT DOCUMENTS

| | | | | | |
|---|---|---|---|---|---|
| 3,860,277 | A * | 1/1975 | Wang | E05B 47/0002 | 292/201 |
| 4,121,319 | A * | 10/1978 | Welch | E05C 17/58 | 16/48.5 |
| 6,151,754 | A * | 11/2000 | Chen | E05C 17/52 | 16/85 |
| 6,584,642 | B2 * | 7/2003 | Hodson | E05F 5/08 | 16/85 |
| 7,159,910 | B2 * | 1/2007 | Hwang | D06F 39/14 | 292/302 |
| 8,702,134 | B2 * | 4/2014 | Lesjak | E05B 63/128 | 292/340 |
| 2007/0069526 | A1 | 3/2007 | Hsu | | |
| 2010/0237637 | A1 * | 9/2010 | Camp | E05B 1/0038 | 292/358 |

FOREIGN PATENT DOCUMENTS

| | | | | | |
|---|---|---|---|---|---|
| DE | 4005285 | A1 | | 8/1991 | |
| DE | 202005008065 | U1 | | 8/2005 | |
| FR | 2616474 | A1 | * | 12/1988 | E05B 15/022 |
| GB | 1394422 | A | * | 5/1975 | E05B 67/365 |
| GB | 1546953 | A | | 2/1977 | |
| GB | 2198778 | A | | 6/1988 | |

* cited by examiner

RETENTION ARRANGEMENT

CROSS-REFERENCE TO RELATED APPLICATIONS

This application claims priority to Great Britain Application No. GB1306883.8 filed on Apr. 16, 2013, the entire contents of which are hereby incorporated by reference herein.

TECHNICAL FIELD

The present invention relates to a retention arrangement for a closure.

BACKGROUND

It is common for a closure such as a window of a heavy industrial or agricultural vehicle to be hinged so as to be movable between an open position and a closed position. Particularly in such a vehicle, which is likely to be operated on uneven terrain, the window may swing about its hinges in an uncontrolled fashion when open. The window may close itself, hinder access through the window opening, or may become damaged or cause damage whilst swinging.

It is known for vehicles such as heavy industrial or agricultural vehicles to include a hold back or retention arrangement configured to retain such a window in an open position, to prevent unwanted movement of the window. One such arrangement comprises a male part attached to the window or window frame, and a corresponding female part attached to the remainder of the vehicle, e.g. the door or door frame, the female part being configured to receive and retain the striker such that the window is retained in an open position.

There are difficulties with such an arrangement. The door and window frames must be aligned with one another so that the male part can successfully enter and be retained in the female part. However, it is possible for there to be misalignment between the window or window frame and the remainder of the vehicle on manufacture. The window or window frame can become misaligned with respect to the remainder of the vehicle during the life of the vehicle, particularly as heavy industrial or agricultural vehicles are commonly used on rough terrain.

There is a need for an improved retention device.

SUMMARY

According to the present invention there is provided a retention arrangement for releasably securing a closure against a fixed body, the retention arrangement comprising a housing defining a mouth configured to receive a striker, the mouth defining a longitudinal axis; and at least one retention element configured to selectively retain said striker within the mouth, and movable between an open position and a closed position. The retention element is resiliently biased towards the closed position. The retention element is configured to open upon displacement due to said striker along the longitudinal axis in a first direction, and to close upon complete insertion of said striker within the mouth. The retention element is configured for rotation about at least two non-parallel axes so as to direct said striker towards the mouth.

The retention element being configured for rotation about more than one axis allows a striker to be offset from the mouth in more than one direction, yet still to be successfully received by the mouth.

The retention element may be resiliently biased transverse to and towards the longitudinal axis.

The retention element may be spherical, and may be configured for free rotation.

A spherical retention element allows a striker to be offset from the mouth by a certain amount in any one of a number of directions, yet still to be successfully received by the mouth.

The retention elements may comprise three spherical retention elements, which may be arranged about the longitudinal axis at equidistant points to one another.

The retention element may utilise a wedge action in conjunction with the striker to prevent release of the striker from the mouth in the closed position.

The arrangement may further comprise a ramp angled with respect to the longitudinal axis and extending away from the longitudinal axis in the first direction, wherein the retention element is resiliently biased towards the ramp along the longitudinal axis in a second direction.

The arrangement may further comprise a release mechanism configured to allow the retention element to move to an open position. The release mechanism may be configured to move the retention element along the longitudinal axis in the first direction.

The retention element may be axially located by a support movable in relation to the ramp, wherein the release mechanism may be configured to move the support along the longitudinal axis in the first direction.

The release mechanism may be integral to the support, and the release mechanism may define an angled surface rotatable about the longitudinal axis with respect to a corresponding angled surface of the housing, such that rotation of the release mechanism in a first direction causes movement of the support along the longitudinal axis in the first direction.

The release mechanism may comprise a lever configured to rotate the release mechanism about the longitudinal axis.

The arrangement may further comprise a release actuator configured to receive said striker when the striker is completely inserted within the mouth, wherein the actuator is resiliently biased towards the striker along the longitudinal axis in a second direction.

The arrangement may further comprise a seal configured for sealing contact with said striker when the striker is completely inserted within the mouth.

The seal may be resiliently biased towards the striker along the longitudinal axis in a second direction.

The arrangement may further comprise a striker. The striker may be adjustable, and/or may be configured for resilient attachment to a closure.

The seal can thus effect removal of the striker from the mouth upon opening of the retention element, e.g. by operation of the release mechanism.

The retention elements may comprise first and second rotatable rods.

There is further provided a retention arrangement for releasably securing a closure against a fixed body, the retention arrangement comprising a housing defining a mouth configured to receive a striker, the mouth defining a longitudinal axis; and at least one retention element configured to selectively retain said striker within the mouth, and movable between an open position and a closed position. The retention element is resiliently biased towards the closed position. The retention element is configured to open upon displacement due to said striker along the longitudinal axis in a first direction, and to close upon complete insertion of said striker within the mouth. The retention element comprises a guidance portion configured to direct said striker towards the mouth from at least two positions offset from the longitudinal axis.

BRIEF DESCRIPTION OF THE DRAWINGS

Other aspects and preferred features of the invention will be readily apparent from the claims and following description of preferred embodiments made, by way of example only, with reference to the following drawings, in which:

DETAILED DESCRIPTIONS

Figure 1:
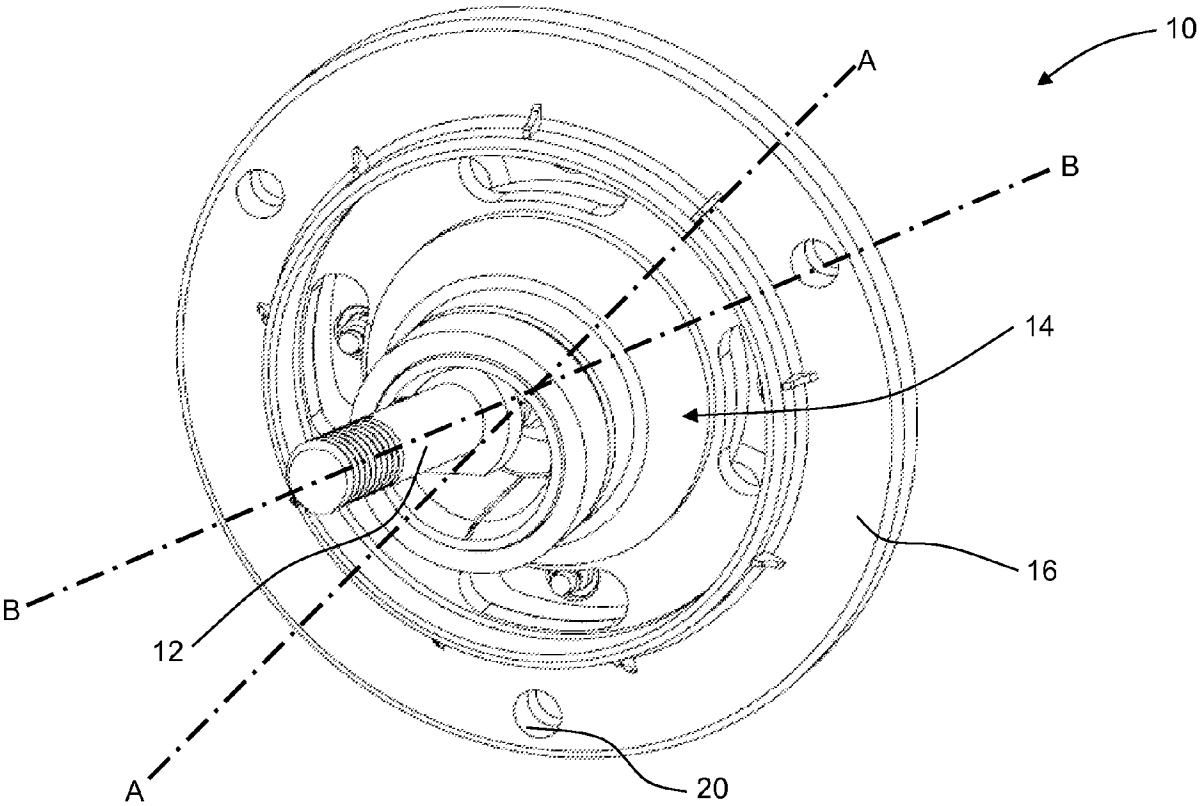
FIG. 1 is a perspective view of a retention arrangement according to an embodiment of the invention with a striker in a misaligned position.

A retention arrangement is generally indicated at 10 in FIG. 1. The retention arrangement 10 is configured for securing a closure such as a window or door to a fixed body, such as a vehicle body or door. The retention arrangement 10 of this embodiment is configured for use on the window of a heavy industrial or agricultural vehicle (not shown), and is intended to secure the window to the vehicle door. In alternative embodiments, the retention arrangement 10 may be used with some other type of closure, e.g. a cover for an aperture.

The arrangement 10 comprises a male part in the form of a striker 12, configured for attachment to a window, and a female part 14, configured to receive and retain the striker 12. Thus, when the striker 12 is retained by the female part 14, the window is secured to the vehicle body.

Figure 2:
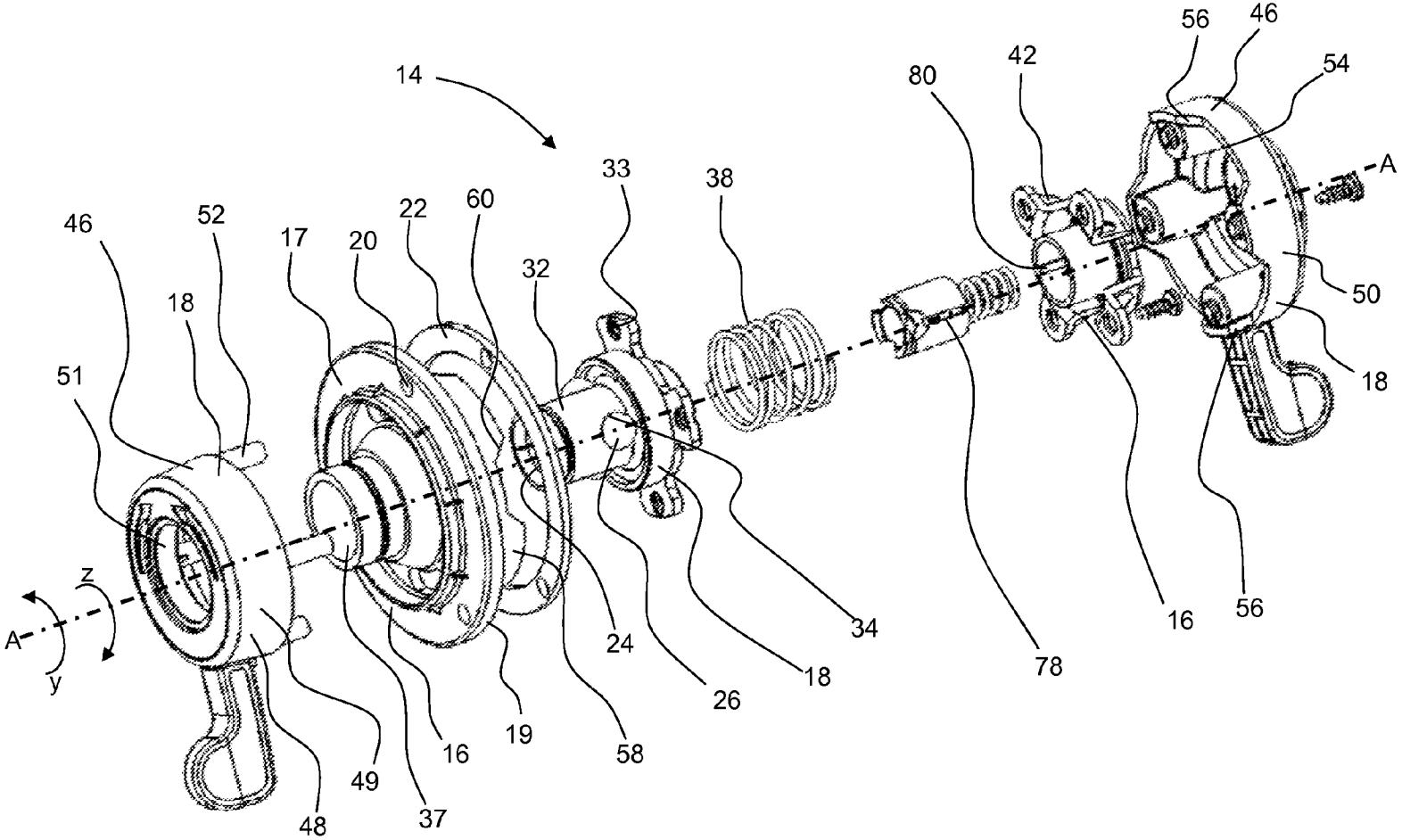
FIG. 2 is an exploded view of a female part of the retention arrangement of FIG. 1.

FIG. 2 is an exploded view of the female part 14. The female part 14 includes a first housing part 16 for fixing to the vehicle body, and a second housing part 18 rotatable in relation to the first housing part 16.

The first housing part 16 includes an outer part 17 configured for attachment to a vehicle door exterior (not shown). The outer part 17 extends through a suitable aperture in the vehicle door exterior to an interior of the vehicle, e.g. to a cab. The outer part 17 has a peripheral flange 19 in which fixing apertures 20 are defined, by which the housing 16 is secured to the vehicle body exterior with suitable fasteners (not shown). A corresponding gasket 22 is secured by the fasteners between the outer part 17 and the vehicle door exterior to provide sealing.

The female part 14 defines a cylindrical mouth 24 configured to receive the striker 12. The mouth 24 defines a longitudinal axis A-A.

The female part 14 also includes a latch in the form of retention elements 26. The elements 26 are configured to selectively retain the striker 12 within the mouth 24, and are movable between an open position where the striker 12 can be inserted into and removed from the mouth 24, and a closed position, where the striker 12 is retained in the mouth 24 (e.g. as shown in FIG. 5). The elements 26 are resiliently biased towards the closed position. That is, in this embodiment, the elements 26 are resiliently biased transverse to and towards the axis A-A, for example as indicated by arrows in FIG. 4.

The elements 26 are configured to move to the open position upon their displacement along the axis A-A in a first, inboard, direction w. In this embodiment, displacement of the elements 26 is effected by the striker 12 as it is inserted into the mouth 24. The elements 26 move to the closed position once insertion of the striker 12 into the mouth 24 is completed, as described below.

The striker 12 of this embodiment has a substantially spherical head 28 on a narrower neck 30. The head 28 and neck 30 are connected by a fillet radius 31. Upon insertion of the striker 12, the elements 26 are displaced along the axis A-A by the head 28 until they reach a point along the axis A-A where they can move transverse to and away from the longitudinal axis A-A, for example as indicated by arrow t in FIG. 4 (as described below). The head 28 then passes the elements 26, and the striker's insertion into the mouth 24 is deemed completed. The elements 26 are then transverse to the narrower neck 30, and return to the closed position in the direction s, retaining the striker 12.

The elements 26 are rotatable substantially transverse to the longitudinal axis A-A. Rotation of the elements 26 by the striker 12 on insertion directs the striker 12 towards the mouth 24. The elements 26 are rotatable about at least two axes, which are not parallel to one another. The striker 12 will thus be directed towards the mouth 24 when the striker 12 approaches the mouth 24 from one of two or more offset positions, and/or at one of two or more angles to the axis A-A.

In this embodiment, the elements 26 are spherical. The elements 26 are supported externally within a support part 32 so as to be freely rotatable about any axis. The support part 32 forms part of the second housing part 18 and is movable with respect to the first housing part 16 along the axis A-A. The elements 26 are thus also movable along the axis A-A with respect to the first housing part 16, allowing their displacement along the axis A-A in the first direction w due to the striker 12.

The support part 32 defines the mouth 24 with a cylindrical wall 36. An outboard end 36*a* of the wall 36 is internally chamfered (see FIG. 4) for ease of insertion of the striker 12 into the mouth 24. The wall 36 has an internal circumferential rib 43 for sealing purposes (as described in further detail below). The wall 36 defines a series of grooves 45 substantially parallel to the axis A-A to encourage run-off of any liquid (e.g. rainwater) that may collect in the mouth 24.

The outer part 17 has a cylindrical wall 35 defining a cylindrical bore 37 configured to fit outside the cylindrical wall 36. The exterior of the wall 36 defines an external peripheral notch 39 configured to receive a seal, for example a wiper seal (not shown) or some other suitable seal, such that a seal is formed between the support part 32 and the outer part 17.

The elements 26 are in this embodiment supported within apertures 34 (see FIG. 4) defined by the cylindrical wall 36. The elements 26 are movable with respect to the support part 32 transverse to the axis A-A in directions s and t, and can extend either side of the wall 36.

Figure 6:
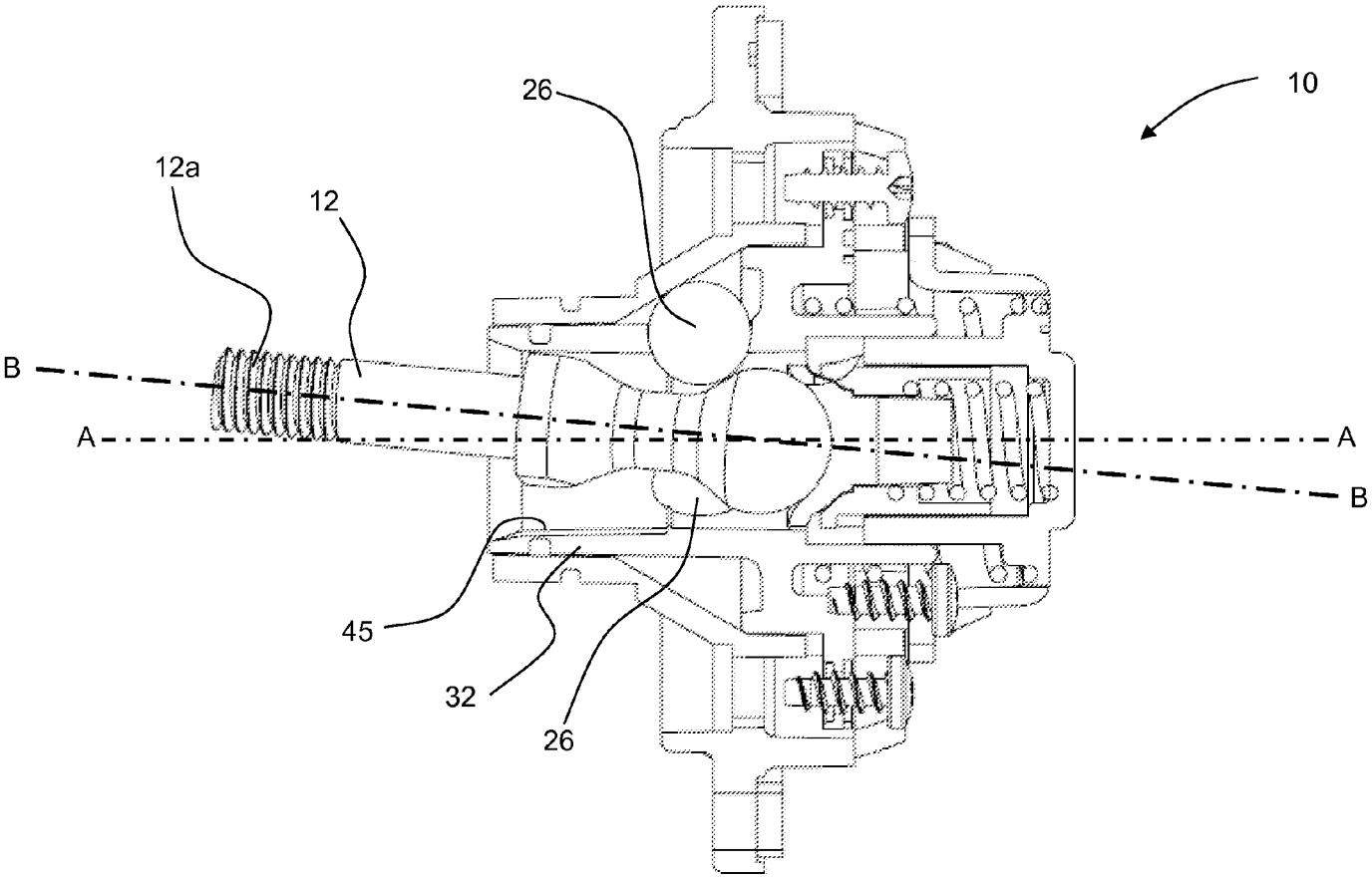
FIG. 6 is a cross-sectional view through the retention arrangement of FIGS. 1 to 5 with the striker in a misaligned position and fully engaged with the retention elements.

In this embodiment, the retention arrangement 10 includes three elements 26 spaced about the axis A-A at equidistant points in the wall 36. There being three equidistant elements 26 allows the striker 12 to approach the mouth 24 from one of a whole range of directions and angles, yet still be successfully received in the mouth 24. For example, FIGS. 1 and 6 show the striker 12 received within the mouth 24 with its longitudinal axis B-B at an angle to the axis A-A. In this embodiment, by way of example, the axis B-B of the striker 12 may be offset from the axis A-A by as much as, for example, 6 mm, yet the striker 12 will be successfully received within the mouth 24. The three elements 26 also allow even distribution of load from the spherical head 28 of the striker 12 when the striker 12 approaches the mouth 24 with its axis B-B at an angle to the axis A-A.

The support part 32 is resiliently biased along the axis A-A in a second, outboard, direction x, so that the elements 26 are also resiliently biased along the axis A-A in the direction x. In this embodiment, a compression spring 38 applies a force to a collar 40 of the support part 32 in the second direction x, providing resilient bias of the elements 26. The spring 38 inhibits jamming of the elements 26. The spring 38 is supported by a retainer 42, which forms part of the first housing part 16. The retainer 42 is fixed to the outer part 17.

Figure 3:
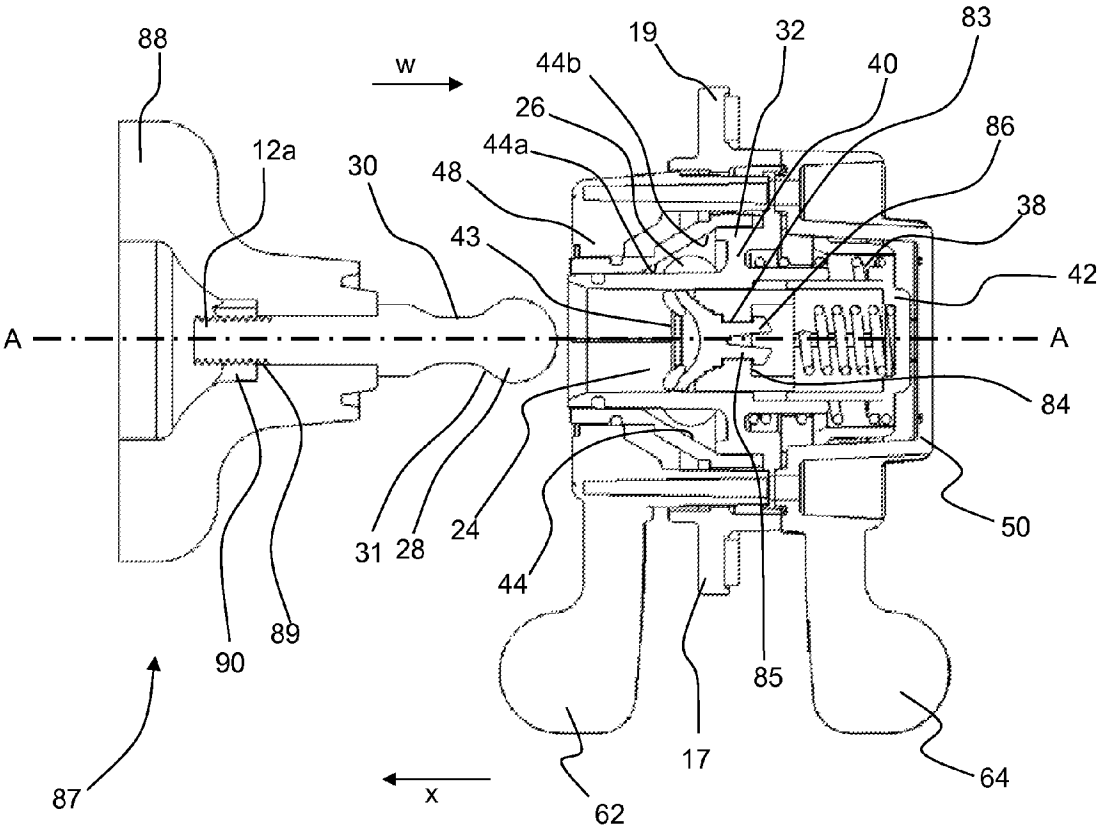
FIG. 3 is a cross-sectional view through the retention arrangement of FIGS. 1 and 2 with the striker approaching the housing in an aligned position.
Figure 4:
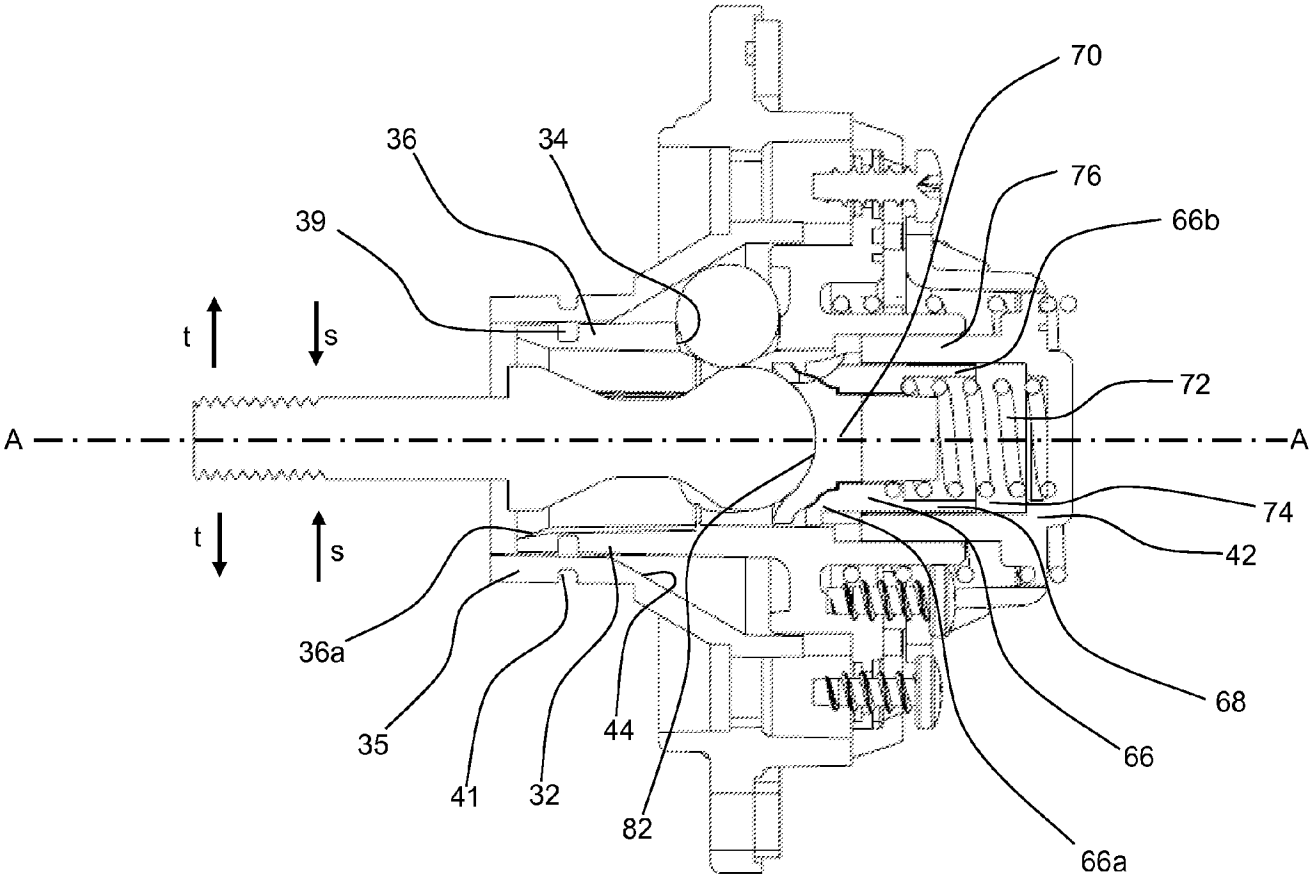
FIG. 4 is a cross-sectional view through the retention arrangement of FIGS. 1 to 3 with the striker becoming engaged with retention elements.
Figure 5:
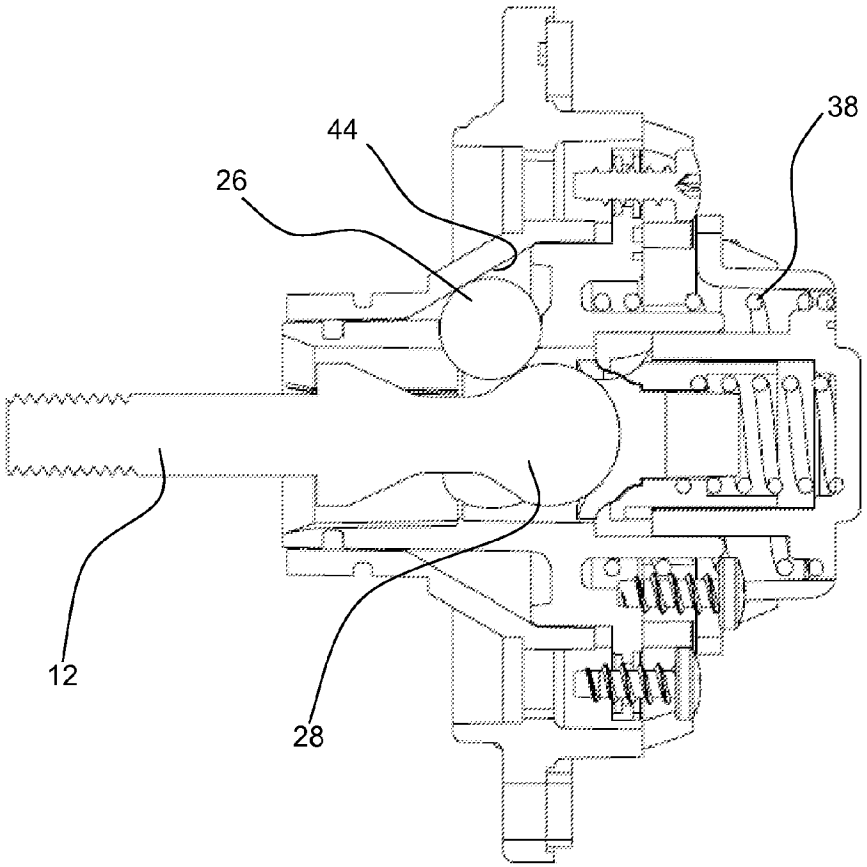
FIG. 5 is a cross-sectional view through the retention arrangement of FIGS. 1 to 4 with the striker fully engaged with the retention elements.

As shown in FIGS. 3 and 4, for example, the outer part 17 defines a ramp 44 angled with respect to the axis A-A. The ramp 44 extends circumferentially about the axis A-A, and extends away from the axis A-A in the first direction w, so that the ramp 44 has a narrower outboard end 44*a* and a wider inboard end 44*b*.

The retention elements 26 are resiliently biased by the spring 38 towards the ramp 44 along the axis A-A in the second direction x. Due to the angle of the ramp 44, the elements 26 are thus resiliently biased transverse to and towards the axis A-A substantially in the direction s, i.e. biased towards a closed position, when in contact with the ramp 44. Displacement of the elements 26 in the first direction w with respect to the ramp 44 moves the elements 26 towards the wider end 44*b* of the ramp 44, providing clearance for the elements 26 to move transverse to and away from the axis A-A substantially in the direction t. The striker head 28 moves the elements 26 transverse to and away from the axis A-A substantially in the direction t as it is inserted into the mouth 24 (e.g. as shown in FIG. 4), moving the elements 26 to the open position and allowing the head 28 to be completely inserted into the mouth 24.

Once the head 28 has passed the elements 26 they are no longer subject to displacement in the first direction w, so return along the axis A-A in the second direction x due to the resilient bias provided by the spring 38. The ramp 44 acts to move the elements 26 transverse to and towards the axis A-A substantially in the direction s, and they are thus returned to the closed position, e.g. as shown in FIG. 5.

Whilst the elements 26 are in the closed position the striker 12 is prevented from being released from the mouth 24. If the striker 12 is moved in the second direction x, the head 28 moves the elements 26 in the second direction x. Due to the narrowing of the ramp 44 in that direction, the elements 26 are wedged by the head 28 into the closed position, and the head 28 cannot pass the elements 26. The striker 12 thus cannot be released from the mouth 24 solely by movement of the striker 12 in the second direction x.

The retention arrangement 10 includes a release mechanism 46. The release mechanism 46 is configured to allow movement of the elements 26 to the open position, so that the striker 12 can be removed from the mouth 24. The release mechanism 46 moves the elements 26 along the axis A-A in the first direction w to the ramp wider end 44*b*, so that they have clearance to move transverse to and away from the axis A-A substantially in the direction t, as follows.

The release mechanism 46 forms part of the second housing part 18, and includes an outboard portion 48 and an inboard portion 50 forming the outermost parts of the female part 14. The outboard portion 48 has a circumferential wall 49 defining a bore 51. The cylindrical wall 35 of the outer part 17 fits within the bore 51. The wall 35 defines an external peripheral notch 41 configured to receive a seal, for example a wiper seal (not shown) or some other suitable seal, such that a seal is formed between the outer part 17 and the outboard portion 48.

The outboard portion 48 has in this embodiment four legs 52 extending inboard substantially parallel to the axis A-A, through the outer part 17. The legs 52 extend into corresponding apertures (not shown) defined by the inboard portion 50, so that the outboard 48 and inboard 50 portions are rotatable together about the axis A-A. The inboard portion 50 is movable axially in relation to the outboard portion 48.

The support part 32 defines apertures 33 by which the support part 32 is fastened to the inboard portion 50 at the legs 52. The release mechanism 46 is configured to move the support part 32 (and thus the elements 26) in the first direction w.

The inboard portion 50 defines a series of recesses 54 about its circumference. The recesses 54 have outwardly angled sides 56, with the sides 56 at either end of a recess 54 extending away from one another. The outer part 17 has corresponding projections 58 with corresponding angled sides 60. The projections 58 are configured to contact the recesses 54.

In order to move the support part 32, the release mechanism 46 is rotated about the axis A-A with respect to the first housing part 16. Due to the angled sides 56, 60, rotation of the release mechanism 46 leads to movement of the inboard portion 50 in the first direction w. The support part 32 is moved with the inboard portion 50, and the elements 26 are thus moved in the first direction w. That is, the elements 26 are moved to the wider end 44*b* of the ramp 44, and therefore have clearance to move transverse to and away from the axis A-A substantially in the direction t.

In this embodiment, the release mechanism 46 can be rotated in a first direction y about the axis A-A, or in a second direction z about the axis A-A. Because the angled sides 56, 60 are angled in opposite directions, rotation in either direction y, z will lead to movement of the inboard portion 50 in the first direction w. In an alternative embodiment (not shown), the surfaces 56, 60 may be angled in one direction only, so that rotation in only one direction will lead to movement of the inboard portion 50 in the first direction w.

The striker 12 is then moved in the second direction x, so that the head 28 moves the elements 26 in the second direction x. The elements 26 are no longer wedged against the ramp 44, and so are also moved transverse to and away from the axis A-A substantially in the direction t to the open position. The radius 31 between the head 28 and the neck 30 eases transverse movement of the elements 26. The head 28 can then pass the elements 26 when moved in the second direction x, and so can be removed from the mouth 24. The angle of the radius 31 affects the force required to remove the striker 12 from the mouth 24. The angle of the radius 31 can be adjusted to adjust the removal force required.

The release mechanism 46 of this embodiment includes a radial lever 62, 64 on each of the outboard 48 and inboard 50 portions, for ease of rotation of the outboard 48 and inboard 50 portions. An outboard lever 62 extends radially from the outboard portion 48, allowing the release mechanism 46 to be easily operated from outside the vehicle. An inboard lever 64 extends radially from the inboard portion 50, allowing the release mechanism 46 to be easily operated from inside the vehicle cab. Movement of either lever 62, 64 in either direction y, z will operate the release mechanism 46. The levers 62, 64 may extend from the release mechanism 46 at any point, and may be aligned with one another, or may be radially misaligned.

In alternative embodiments, the release mechanism 46 includes some other means of improving ease of operation, such as an axial extension. The release mechanism 46 may be operated remotely, for example by a cable or rod. For example, an actuation cable or rod may extend from the release mechanism 46, e.g. to a lever positioned within the cab remote to the release mechanism 46.

In alternative embodiments, the release mechanism 46 does not include levers, and can be operated by rotation of the outboard 48 and/or inboard 50 portions directly, without a lever. In further alternative embodiments, the release mechanism 46 is operated by moving the outboard portion 48 or the inboard portion 50 in the first direction w, with no need for rotation.

The striker 12 can be removed from the mouth 24 by hand. However, in this embodiment, a removal mechanism is provided in the form of a release actuator 66. The actuator 66 applies force to the striker 12 in the second direction x as follows, causing the striker 12 to be removed from the mouth 24 automatically once the elements 26 can be moved to the open position.

The actuator 66 has an outboard end 66*a* and an inboard end 66*b*, and has a cylindrical main body 68 and a sealing insert 70. A compression spring 72 acts between the body 68 and the retainer 42 to bias the actuator 66 in the second direction x. The insert 70 is of rubber or some other suitable resilient material, and forms a peripheral seal within the mouth 24. With the above-described seals (not shown) and the gasket 22, the exposed, outboard side of the retention arrangement is thus fully sealed from the inboard components such as the springs 38, 72.

The actuator 66 is movable along the axis A-A within the mouth 24 and a cylindrical aperture 74 defined by a cylindrical wall 76 of the retainer 42. The body 68 defines a series of external grooves 78 parallel to the axis A-A and configured to receive corresponding ribs 80 protruding from the interior of the wall 76. The interaction of the grooves 78 and ribs 80 prevents unwanted rotation of the actuator 66 with respect to the retainer 42, reducing wear of the insert 70. When the striker 12 is not received within the mouth 24, the insert 70 is biased to form a seal against the rib 43 and the elements 26.

The body 68 defines a central bore 83 configured to receive the insert 70 (see FIG. 3). The bore 83 widens at a step 84 towards the inboard end 66*b*. The insert 70 has a split-pin type body 85 with a mushroom-shaped inboard end 86. On assembly, the body 85 is compressed for insertion through the bore 83. When the end 86 passes beyond the step 84 in the first direction w, the body 85 opens out, and the end 86 against the step 84 prevents movement of the insert 70 in the second direction x, retaining the insert 70 in the body 68.

The actuator 66 receives the striker head 28 when the striker 12 is inserted into the mouth 24. The insert 70 defines a rounded cup 82 corresponding to the spherical head 28 towards the outboard end 66*a*, in which the head 28 is received. The bias of the actuator 66 towards the striker 12 inhibits rattling and damage of the striker 12 when received within the mouth 24, and applies force to the striker 12 in the second direction x. When the release mechanism 46 is operated as described above, the actuator 66 provides the force required for the striker head 28 to act in the second direction x against the elements 26, and for the striker 12 to be removed from the mouth 24. The striker 12 is thus automatically ejected from the mouth 24 upon operation of the release mechanism 46. Different springs 72 can be used to provide the required amount of spring force used to eject the striker 12 from the mouth 24, which can be varied to correspond to the required striker removal force.

In alternative embodiments (not shown), the striker head 28 may be of an alternative shape, and the insert 70 may be of a corresponding alternative shape.

Alternatively, the striker 12 can be removed from the mouth 24 manually, e.g. by movement of the window, once the release mechanism 46 has been operated. In an alternative embodiment, the actuator 66 does not provide a resilient bias in the direction x, and such manual removal of the striker 12 is used.

The retention arrangement 10 further includes a striker mounting arrangement 87 for mounting the striker 12 to the vehicle body (see FIG. 3). The mounting arrangement 87 of this embodiment includes a base 88 defining a bore 89 configured to receive the striker 12, and an integral nut 90. The striker 12 has a cylindrical, threaded, end 12*a* opposite the head 28. The end 12*a* is screwed into the nut 90, thus attaching the striker 12 to the mounting arrangement 87. The striker 12 can be screwed into the mounting arrangement 87 by varying amounts, so that the striker 12 is adjustable with respect to the mounting arrangement 87. The striker 12 position can thus be adjusted if required for different vehicles, or to account for wear of the vehicle during use.

The base 88 is in this embodiment of rubber or some other suitable resilient material. The striker 12 is thus resiliently attached to the vehicle so that its longitudinal axis B-B can be adjusted in relation to the vehicle, allowing for some offset of the striker 12 in relation to the female part 14.

In alternative embodiments (not shown), the base 88 may include a plate for additional rigidity, e.g. a steel plate. The mounting arrangement 87 may include an alternative means of attaching the striker 12 to the door, such as a ball and socket joint. The position of the mounting arrangement 87 and/or the female part 14 may be adjustable in relation to the respective vehicle parts.

In an alternative embodiment (not shown), the elements may be two or more rotatable rollers, arranged with longitudinal axes at an angle to one another.

In an alternative embodiment, rather than rotatable elements, the retention element comprises a guidance portion configured to direct said striker towards the mouth from at least two positions offset from the longitudinal axis. For example, the element may be an extendable collar resiliently biased towards a closed position, or some other type of collet.

In this embodiment, the housing parts 16, 18 and actuator body 68 are of a suitably hard-wearing material such as, for example, glass-filled plastic, e.g. 30% glass-filled nylon, or acetal. In alternative embodiments, some or all of the housing parts 16, 18 and the actuator body 68 may be of a suitable metal.

The retention arrangement 10 provides a simple and effective means of securing an open window against a vehicle body. The retention arrangement 10 can advantageously overcome a degree of offset between the striker and the female part. The striker can successfully be received within the mouth when approaching from a range of directions, and/or at a range of angles. An effective wedge arrangement prevents unwanted release of the striker from the female part. A simple release mechanism is used to release the striker, and the striker is automatically ejected from the mouth upon operation of the release mechanism. The retention arrangement 10 can be installed whilst fully assembled, e.g. by the attachment of the outer part 17 to a vehicle closure. The retention arrangement 10 is simple to assemble, and the materials used are cost-effective and suitably corrosion-resistant.

What is claimed is:

1. A retention arrangement for releasably securing a closure against a fixed body, the retention arrangement comprising:

a housing defining a mouth configured to receive a striker, the mouth defining a longitudinal axis; wherein the housing comprises a support;

at least one retention element axially located by the support and configured to selectively retain said striker within the mouth, and movable between an open position and a closed position;

a resilient biasing arrangement configured to resiliently bias the support to move the retention element towards the closed position;

the housing further comprising a release mechanism configured to allow the retention element to move to the open position and configured to move the retention element along the longitudinal axis in a first direction;

a ramp angled with respect to the longitudinal axis and extending away from the longitudinal axis in the first direction wherein the support is movable in relation to the ramp, wherein the release mechanism is configured to move the support along the longitudinal axis in the first direction;

wherein the retention element is configured to open upon displacement due to said striker along the longitudinal axis in a first direction, and to close upon complete insertion of said striker within the mouth; and wherein the retention element is configured for rotation about at least two non-parallel axes so as to direct said striker towards the mouth.

2. An arrangement according to claim 1 wherein the retention element is resiliently biased transverse to and towards the longitudinal axis.

3. An arrangement according to claim 1 wherein the retention element is spherical.

4. An arrangement according to claim 3 wherein the retention element is configured for free rotation.

5. An arrangement according to claim 3 wherein the retention elements comprise three spherical retention elements.

6. An arrangement according to claim 5 wherein the spherical elements are arranged about the longitudinal axis at equidistant points to one another.

7. An arrangement according to claim 1 wherein the retention element utilizes a wedge action in conjunction with the striker to prevent release of the striker from the mouth in the closed position.

8. An arrangement according to claim 1 further comprising a ramp angled with respect to the longitudinal axis and extending away from the longitudinal axis in the first direction, wherein the retention element is resiliently biased towards the ramp along the longitudinal axis in a second direction.

9. An arrangement according to claim 1 wherein the release mechanism is integral to the support, and wherein the release mechanism defines an angled surface rotatable about the longitudinal axis with respect to a corresponding angled surface of the housing, such that rotation of the release mechanism in a first direction causes movement of the support along the longitudinal axis in the first direction.

10. An arrangement according to claim 9 wherein the release mechanism comprises a lever configured to rotate the release mechanism about the longitudinal axis.

11. An arrangement according to claim 1 wherein the release mechanism further comprises a release actuator configured to receive said striker when the striker is completely inserted within the mouth, wherein the actuator is resiliently biased towards the striker along the longitudinal axis in a second direction.

12. An arrangement according to claim 1 further comprising a seal configured for sealing contact with the striker when the striker is completely inserted within the mouth.

13. An arrangement according to claim 12 wherein the seal is resiliently biased towards said striker along the longitudinal axis in a second direction.

14. An arrangement according to claim 1 wherein the striker is adjustable.

15. A retention arrangement for releasably securing a closure against a fixed body, the retention arrangement comprising:

a housing defining a mouth configured to receive a striker, the mouth defining a longitudinal axis; wherein the housing comprises a support;

at least one retention element axially located by the support and configured to selectively retain said striker within the mouth, and movable between an open position and a closed position;

a resilient biasing arrangement configured to resiliently bias the support to move the retention element towards the closed position;

the housing further comprising a release actuator configured to receive said striker when the striker is completely inserted within the mouth, wherein the actuator is resiliently biased towards the striker along the longitudinal axis in a second direction;

wherein the retention element is configured to open upon displacement due to said striker along the longitudinal axis in a first direction, and to close upon complete insertion of said striker within the mouth;

wherein the retention element is configured for rotation about at least two non-parallel axes so as to direct said striker towards the mouth.

16. An arrangement according to claim 15 wherein the retention element is resiliently biased transverse to and towards the longitudinal axis.

17. An arrangement according to claim 15 wherein the retention element is spherical.

18. An arrangement according to claim 17 wherein the retention element is configured for free rotation.

19. An arrangement according to claim 17 wherein the retention elements comprise three spherical retention elements.

20. An arrangement according to claim 19 wherein the spherical elements are arranged about the longitudinal axis at equidistant points to one another.

21. An arrangement according to claim 15 wherein the retention element utilizes a wedge action in conjunction with the striker to prevent release of the striker from the mouth in the closed position.

22. An arrangement according to claim 15 further comprising a ramp angled with respect to the longitudinal axis and extending away from the longitudinal axis in the first direction, wherein the retention element is resiliently biased towards the ramp along the longitudinal axis in a second direction.

23. An arrangement according to claim 15 further comprising a release mechanism configured to allow the retention element to move to the open position and configured to move the retention element along the longitudinal axis in the first direction, and further comprising a ramp angled with respect to the longitudinal axis and extending away from the longitudinal axis in the first direction wherein the housing comprises a support movable in relation to the ramp, wherein the retention element is axially located by the support, and wherein the release mechanism is configured to move the support along the longitudinal axis in the first direction.

24. An arrangement according to claim 23 wherein the release mechanism is integral to the support, and wherein the release mechanism defines an angled surface rotatable about the longitudinal axis with respect to a corresponding angled surface of the housing, such that rotation of the release mechanism in a first direction causes movement of the support along the longitudinal axis in the first direction.

25. An arrangement according to claim 24 wherein the release mechanism comprises a lever configured to rotate the release mechanism about the longitudinal axis.

26. An arrangement according to claim 15 further comprising a seal configured for sealing contact with the striker when the striker is completely inserted within the mouth.

27. An arrangement according to claim 26 wherein the seal is resiliently biased towards said striker along the longitudinal axis in a second direction.

28. An arrangement according to claim 15 wherein the striker is adjustable.

29. An arrangement according to claim 15 wherein the striker is configured for resilient attachment to a closure.

* * * * *